US005577645A

United States Patent [19]

Seitz

[11] Patent Number: 5,577,645

[45] Date of Patent: Nov. 26, 1996

[54] SHOULDER GUARD WITH POSITIVE MECHANICAL LOCK AND VISUAL INDICATORS

[75] Inventor: Joel N. Seitz, Parsippany, N.J.

[73] Assignee: P.D.S. Product Development Corp., South Hackensack, N.J.

[21] Appl. No.: 564,412

[22] Filed: Nov. 29, 1995

[51] Int. Cl.[6] ..... A47G 25/20; A47G 25/14

[52] U.S. Cl. ..... 223/87; 223/98

[58] Field of Search ..... 223/87, 85, 92, 223/98; D6/315, 316

[56] References Cited

U.S. PATENT DOCUMENTS

| | | | |
|---|---|---|---|
| 1,201,195 | 10/1916 | Kinsinger, Sr. . | |
| 2,147,590 | 2/1939 | Adkins . | |
| 2,301,403 | 11/1942 | Hirsch . | |
| 2,873,054 | 2/1959 | Zintel . | |
| 3,033,430 | 5/1962 | Zintel . | |
| 3,117,706 | 1/1964 | Kestner | 223/87 |
| 3,145,888 | 8/1964 | Tillery | 223/87 |
| 3,202,330 | 8/1965 | Hawkins . | |
| 3,231,159 | 1/1966 | Taff . | |
| 3,285,481 | 11/1966 | Zintel . | |
| 3,363,812 | 1/1968 | Hawkins . | |
| 4,944,436 | 7/1990 | Moen et al. . | |
| 4,988,022 | 1/1991 | Seitz | 223/87 |
| 5,139,184 | 8/1992 | Seitz | 223/98 |
| 5,388,734 | 2/1995 | Seitz | 223/87 |
| 5,390,835 | 2/1995 | Murphy et al. | 223/87 |

*Primary Examiner*—J. Bibhu Mohanty
*Attorney, Agent, or Firm*—Samuelson & Jacob

[57] ABSTRACT

A shoulder guard for a garment hanger is erected from an essentially flat sheet of material to include a first panel and a second panel, with at least the first panel following a desired convex contour configuration to complement the garment to be hung on the hanger, the second panel being divided into a pair of sub-panels pulled longitudinally toward one another to bow at least the first panel into the desired convex contour configuration, with the sub-panels locked together by interengaged lateral slits against relative longitudinal movement, the slits defining tabs for confronting the sub-panels to shape and reinforce the sub-panels in a convex contour configuration, and indicia providing a visual indication of the proper confronting relationship between the tabs and the sub-panels.

10 Claims, 3 Drawing Sheets

SHOULDER GUARD WITH POSITIVE MECHANICAL LOCK AND VISUAL INDICATORS

The present invention relates generally to shoulder guards used in connection with garment hangers and pertains, more specifically, to a garment hanger shoulder guard of the type erected from an essentially flat sheet of material to include a front panel and a back panel, and a positive mechanical locking arrangement to hold the shoulder guard in the erected condition, with at least the front panel bowed to follow a desired convex contour configuration for complementing essentially a garment to be hung on the hanger.

Garment hangers constructed of wire have become the most widely accepted garment hangers for use in connection with handling garments in dry cleaning establishments. Shoulder guards constructed of flat card stock are utilized in connection with such hangers almost universally to protect garments against wrinkling and other distortion while hung upon the hangers. These shoulder guards usually are supplied to dry cleaning establishments in a flat configuration, separate from the garment hangers, and must be erected and assembled with the hangers. Once erected, the shoulder guard provides a contour configuration essentially complementary to the portion of the garment draped over the hanger, enabling the garment to be draped over the wire hanger free of wrinkles and distortion.

The present invention provides a positive mechanical locking arrangement for enabling erection of the garment hanger shoulder guard at the dry cleaning establishment, without requiring supplemental fasteners or adhesives, subsequent to shipping the shoulder guard in the flat condition most conducive to shipping and storage. As such, the present invention attains several objects and advantages, some of which are summarized as follows: Enables a flat compact configuration for shipping to, and storage at, a dry cleaning establishment and simple subsequent erection at the site for ready use, without the necessity for supplemental fasteners or adhesives, and without requiring special tools or special skills; attains an erect condition in a garment hanger shoulder guard with increased ease, which condition provides the desired convex contour configuration for complementing the garment to be hung on the hanger; provides a positive mechanical locking arrangement for holding the erect condition of the shoulder guard, with the desired convex contour configuration, fixed against forces encountered during service, without supplemental fasteners or adhesives; enables the positive mechanical locking arrangement to be operated with ease to assure rapid and effective set-up, coupled with exemplary performance during service; employs component parts of the mechanical locking arrangement to shape and reinforce the desired contour configuration; includes visual indicators which provide a visible indication of the proper engagement of the mechanical locking arrangement for maximum effectiveness in attaining the desired contour configuration in the erected shoulder guard; enables relatively simple manufacture in large quantities of consistently high quality for widespread adoption and use.

The above objects and advantages are attained by the present invention which may be described briefly as a shoulder guard for a garment hanger, the shoulder guard being of the type erected from an essentially flat sheet of material to include a first panel and a second panel, with at least the first panel following a desired convex contour configuration to complement essentially a garment to be hung on the hanger, the first and second panels each extending longitudinally between opposite ends, the shoulder guard comprising: a first edge extending longitudinally along the first panel; a second edge extending longitudinally along the second panel; an apical portion extending longitudinally between the opposite ends of the panels, laterally intermediate the first edge and the second edge; a gap located between the opposite ends of the second panel and dividing the second panel into first and second sub-panels each extending between the gap and a corresponding opposite end of the second panel, each sub-panel including a second edge portion, an outer surface and an inner surface; an opening located between the opposite ends of the first and second panels, intermediate the first and second edges, the opening communicating with the gap; a first slit in the first sub-panel, the first slit extending generally laterally from the opening toward the corresponding second edge portion and including a terminus spaced laterally away from the corresponding second edge portion, the first slit being spaced longitudinally from the gap toward the corresponding end of the first panel to establish a first tab on the first sub-panel, adjacent the gap, between the gap and the first slit; and a second slit in the second sub-panel, the second slit extending generally laterally from the corresponding second edge portion toward the apical portion and including a terminus spaced laterally away from the apical portion, the second slit being spaced longitudinally from the gap toward the corresponding end of the second panel to establish a second tab on the second sub-panel, adjacent the gap, between the gap and the second slit; the relative location and extent of the first and second slits being such that upon interengagement of the first and second slits and juxtaposition of the terminus of the first slit with the terminus of the second slit, the first and second sub-panels are locked together against relative longitudinal movement, with at least the first panel bowed into the desired convex contour configuration.

The invention will be understood more fully, while still further objects and advantages will become apparent, in the following detailed description of a preferred embodiment of the invention illustrated in the accompanying drawing, in which.

Figure 1:
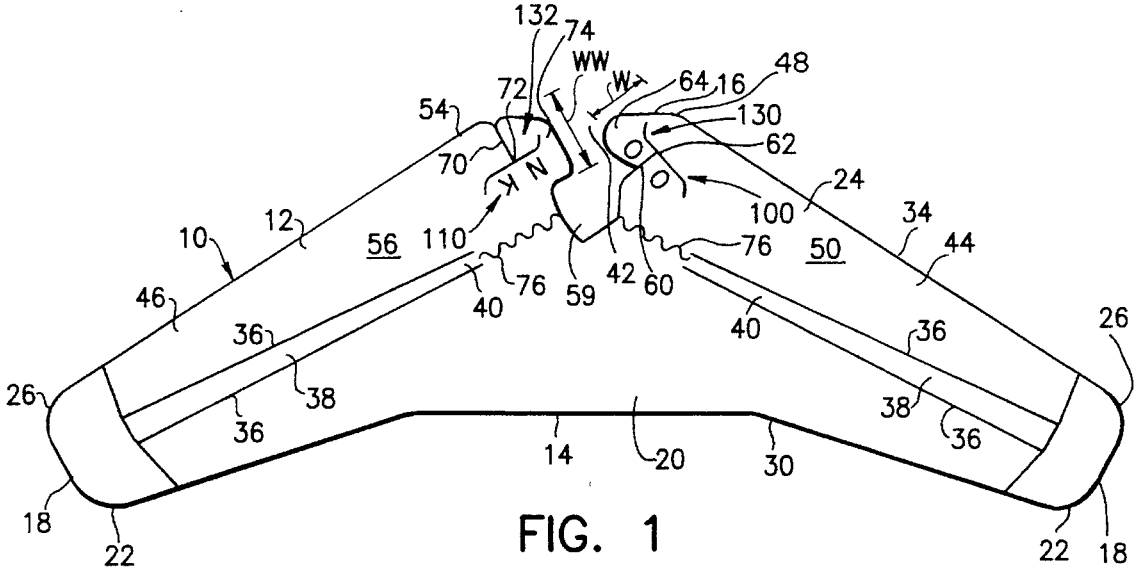
FIG. 1 is a top plan view of a blank from which a shoulder guard of the present invention is erected.

Referring now to the drawing, and especially to FIG. 1 thereof, a blank 10 is constructed of a sheet 12 of card stock, or a like material having similar resilient characteristics, and is seen to have a plan configuration which includes a front 14, a rear 16 spaced laterally from the front 14, and longitudinally opposite ends 18. A first panel in the form of front panel 20 extends between opposite ends 22, and a second panel in the form of rear panel 24 extends between opposite ends 26. A first edge 30 extends along the front panel 20 and a second edge 34 extends along the rear panel 24. Longitudinal score lines 36 define spine sections 38 extending longitudinally between the opposite ends 18, laterally intermediate the first and second edges 30 and 34, along apical portions 40 of the blank 10.

Figure 3:
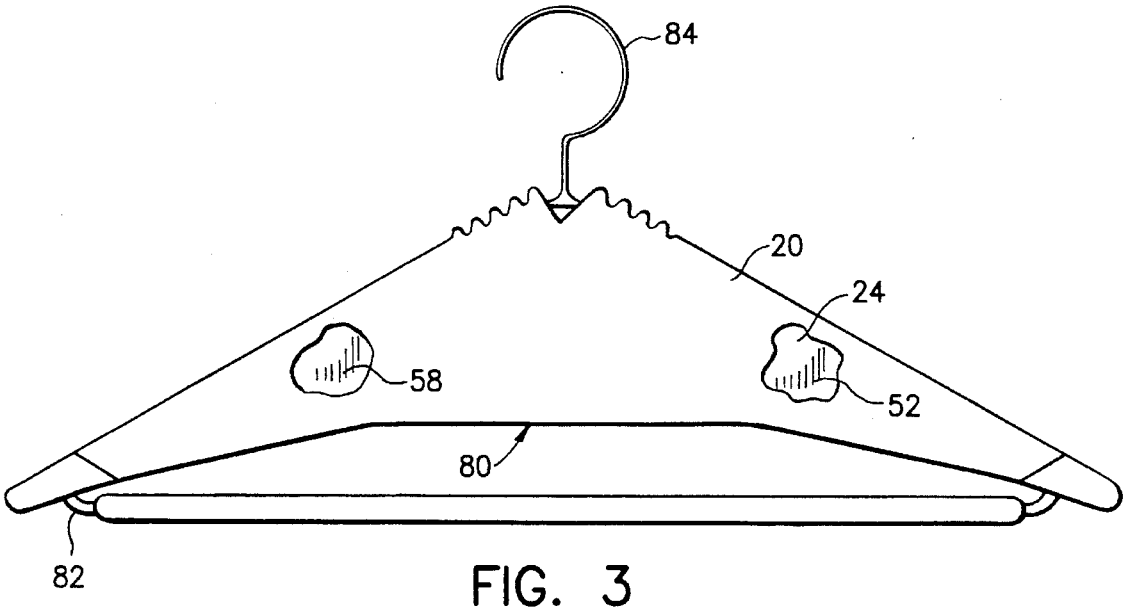
FIG. 3 is a front elevational view of the shoulder guard erected and assembled with a wire hanger.

A gap 42 is located essentially centrally between the opposite ends 26 of the rear panel 24 and divides the rear panel 24 into a first sub-panel 44, extending longitudinally between the gap 42 and one opposite end 26, and a second sub-panel 46, extending between the gap 42 and the other opposite end 26. First sub-panel 44 has an edge portion 48 of second edge 34, an outer surface 50 and an inner surface 52 (see FIG. 3), and second sub-panel 46 likewise has an edge portion 54 of second edge 34, an outer surface 56 and an inner surface 58 (see FIG. 3). Gap 42 communicates with an opening 59 located longitudinally centrally between the ends 18 and intermediate the first and second edges 30 and 34.

A first slit 60 in the first sub-panel 44 extends laterally from the opening 59 toward the edge portion 48 of the second edge 34 and includes a terminus 62 spaced laterally away from the edge portion 48. First slit 60 is spaced longitudinally from the gap 42 toward the corresponding end 26 of the rear panel 24 and establishes a first tab 64 on the first sub-panel 44, adjacent the gap 42, between the gap 42 and first slit 60. A second slit 70 in the second sub-panel 46 extends laterally from the edge portion 54 of second edge 34 toward the apical portion 40 and includes a terminus 72 spaced laterally away from the apical portion 40. Second slit 70 is spaced longitudinally from the gap 42 toward the corresponding end 26 of the rear panel 24 and establishes a second tab 74 on the second sub-panel 46, adjacent the gap 42, between the gap 42 and second slit 70. In the preferred embodiment, first and second slits 60 and 70 follow a generally straight line, each being essentially perpendicular to a corresponding edge portion 48 and 54, respectively. Undulant slits 76 extend along the apical portion 40 from the opening 59 toward each spine section 38 for purposes which will be described below.

Figure 2:
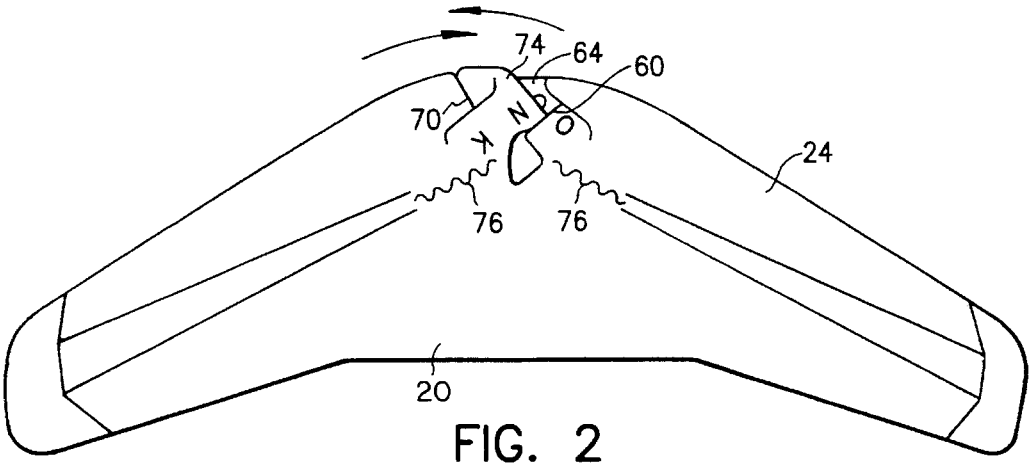
FIG. 2 is a top plan view similar to FIG. 1, but with the shoulder guard partially erected.

When it is desired to erect the shoulder guard for use, the front panel 20 and the rear panel 24 are bent about the score lines 36 while the first and second tabs 64 and 74 are overlapped to bring the first and second slits 60 and 70 into interengagement, as seen in FIG. 2. In doing so, the first tab 64 is slipped beneath the second tab 74, with the second tab 74 entering the slit 60 and moved beneath the first sub-panel 44 until the first and second slits 60 and 70 are aligned with one another. Then, the first and second sub-panels 44 and 46 are shifted relative to one another to engage the first and second slits 60 and 70 with one another until the terminus 62 of the first slit 60 is juxtaposed with, and is contiguous with, the terminus 72 of the second slit 70, whereupon the first and second sub-panels 44 and 46 are locked together against relative longitudinal movement, in a fully erect shoulder guard 80, illustrated in FIGS. 3 and 4. A wire hanger 82 then is slipped into the erected shoulder guard 80 to complete the assembly, the undulant slits 76 serving to ease the insertion of a hook 84 of the wire hanger 82 through the erected shoulder guard 80.

Figure 5:
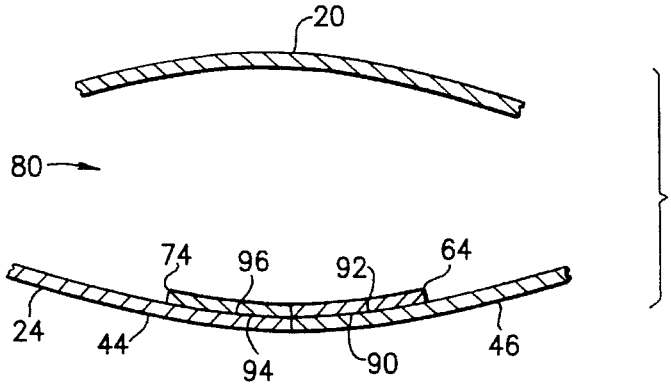
FIG. 5 is an enlarged fragmentary cross-sectional view taken along the line 5—5 of FIG. 4.

As the sub-panels 44 and 46 are pulled together to interengage the slits 60 and 70, the front panel 20 is bowed into the desired convex contour configuration, and once the slits 60 and 70 are fully interengaged, as set forth above, the sub-panels 44 and 46 are locked together, against longitudinal movement relative to one another, as a result of the location and extent of the slits 60 and 70, to secure the desired convex contour configuration. At the same time, the relative positions of the tabs 64 and 74, in concert with the resilient nature of the material of sheet 12, shape and reinforce a bowed convex contour configuration in the rear panel 24, all as illustrated in FIG. 5. Thus, as best seen in FIG. 5, a first outer surface portion 90 along the first tab 64 confronts a counterpart first inner surface portion 92 of the second sub-panel 46, while a second outer surface portion 94 along the second tab 74 confronts a counterpart second inner surface portion 96 of the first sub-panel 44. In this manner, both the front panel 20 and the rear panel 24 are bowed and are secured in the desired convex contour configuration, with the tabs 64 and 74 serving to urge portions of the sub-panels 44 and 46 outwardly to shape and reinforce the bowed rear panel 24 in the region where the sub-panels 44 and 46 are joined. The resilient nature of the material of sheet 12 attains appropriate shaping and retention of the desired contour configuration.

In order to maximize the reinforcement made available by the location of the tabs 64 and 74 behind the corresponding portions of the sub-panels 44 and 46, while facilitating attainment of the proper engagement of the tabs 64 and 74, as described, the first tab 64 is provided with a lateral width W somewhat less than the lateral width WW of the second tab 74. It is noted that the desired convex contour configuration in both the front panel 20 and the rear panel 24 is a smooth and continuous curved contour, and is attained without the necessity for any further score lines which could interrupt the smooth and continuous nature of the contour configuration. The absence of such additional score lines adds to the strength of the erected shoulder guard 80, enhancing the ability of the shoulder guard to support a garment draped over the shoulder guard 80, while providing a more aesthetically pleasing appearance to the shoulder guard 80. The straight line configuration of the slits 60 and 70, coupled with the orientation of the slits 60 and 70 perpendicular to the respective edge portions 48 and 54, enable ease of interengagement of the slits 60 and 70 while attaining the desired resistance to relative longitudinal movements of the sub-panels 44 and 46 for securement of the shoulder guard 80 in the erect condition, with the front and rear panels 20 and 24 bowed to follow the desired convex contour configuration, and without the necessity for supplemental fasteners or adhesives.

Figure 4:
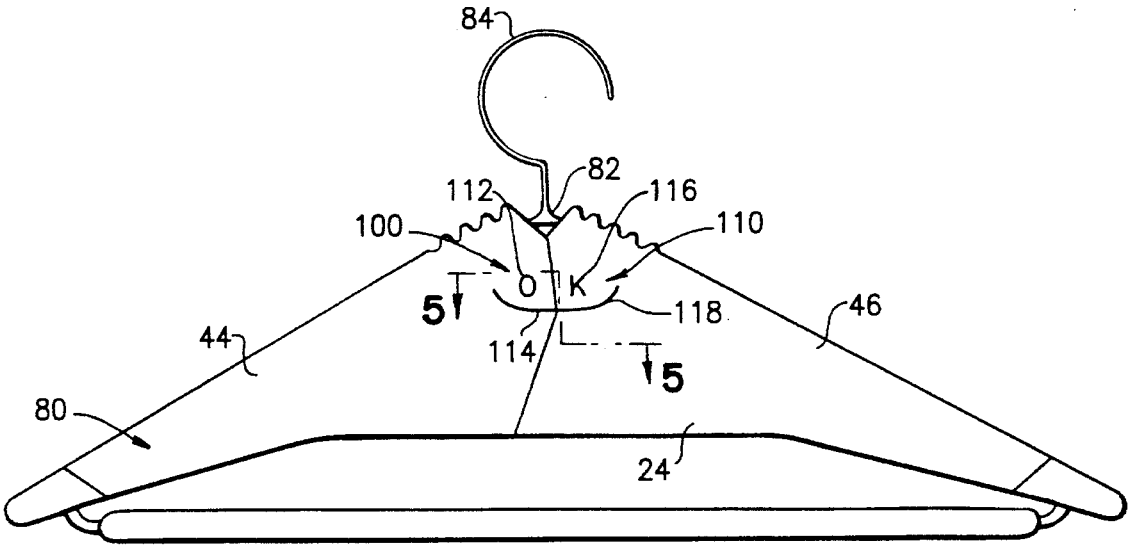
FIG. 4 is a rear elevational view of the shoulder guard erected and assembled with the wire hanger.

In order to assist in the appropriate placement of the tabs 64 and 74 as described, visual indicators are provided to enable a positive visual confirmation of the proper placement of the tabs 64 and 74. Thus, first positive indicia 100 is located on the outer surface 50 of the first sub-panel 44, closely adjacent the first slit 60, between the first slit 60 and the corresponding end 26 of the rear panel 24. Second positive indicia 110 is located on the outer surface 56 of the second sub-panel 46, closely adjacent the second tab 74, between the second tab 74 and the corresponding end 26 of the rear panel 24. First and second positive indicia 100 and 110 are complementary such that when the slits 60 and 70 are fully engaged, with the tabs 64 and 74 in appropriate relative positions, as described above in connection with FIG. 5, the location and the complementary nature of indicia 100 and 110 enable the indicia 100 and 110 to be visible and to be combined to provide a visible confirmation that the tabs 64 and 74 are in the proper relative positions described above. In the illustrated embodiment, the indicia 100 include the letter "O", at 112 and an upturned curved segment 114, while the indicia 110 include the letter "K", at 116 and an upturned curved segment 118. When combined, as seen in FIG. 4, the indicia 100 and 110 together display the term "OK", comprised of the letter "O" at 112 and the letter "K" at 116, and a smile, comprised of the joined upturned segments 114 and 118. The indicia 100 and 110 preferably are embossed or imprinted in the sheet 12.

Figure 6:
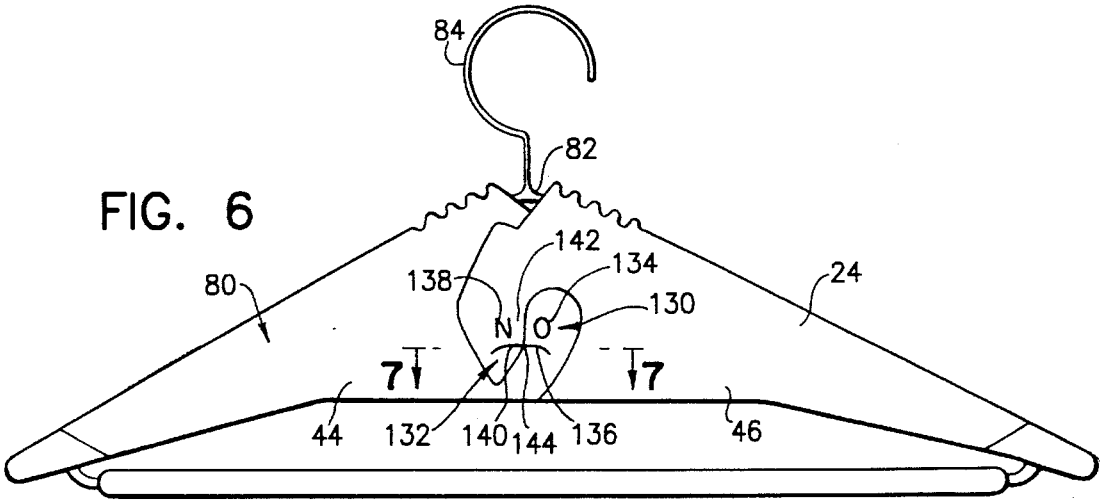
FIG. 6 is a rear elevational view similar to FIG. 4, but with component parts shown in another erect condition.
Figure 7:
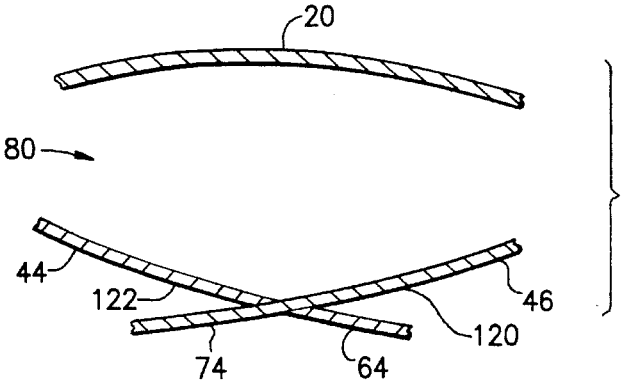
FIG. 7 is an enlarged fragmentary cross-sectional view taken along the line 7—7 of FIG. 6.

Should the tabs 64 and 74 inadvertently be mismatched, as shown in FIGS. 6 and 7, wherein the slits 60 and 70 have been engaged fully, but with the tabs 64 and 74 in relative positions wherein the first tab 64 improperly overlies the outer surface portion 120 of the second sub-panel 46, and the second tab 74 improperly overlies the outer surface portion 122 of the first sub-panel 44, first negative indicia 130 on the outer surface portion 90 of the first tab 64 combine with complementary second negative indicia 132 on the outer surface portion 94 of the second tab 74 to provide an indication that the tabs 64 and 74 are not in the proper relative locations. In the illustrated embodiment, the first negative indicia 130 include the letter "O", at 134 and a downturned curved segment 136, while the second negative indicia 132 include the letter "N", at 138 and a downturned curved segment 140. When the tabs 64 and 74 are mismatched, as illustrated in FIGS. 6 and 7, the negative indicia 130 and 132 are combined to establish a negative visual indication in the form of the term "NO", at 142, and a frown 144. It is noted, however, that even when the tabs 64 and 74 are mismatched, as illustrated in FIGS. 6 and 7, the fully engaged slits 60 and 70 lock the sub-panels 44 and 46 against relative longitudinal movement and secure the front panel 20 in the desired bowed, convex contour configuration. The rear panel 24, while also bowed somewhat, does not have the benefit of the shaped, reinforced bowed, convex contour configuration provided by the properly engaged tabs 64 and 74. The indicia 130 and 132 preferably are embossed or imprinted in the sheet 12.

It will be apparent that the above described preferred embodiment of the invention attains the several objects and advantages summarized above, namely: Enables a flat compact configuration for shipping to, and storage at, a dry cleaning establishment and simple subsequent erection at the site for ready use, without the necessity for supplemental fasteners or adhesives, and without requiring special tools or special skills; attains an erect condition in a garment hanger shoulder guard with increased ease, which condition provides the desired convex contour configuration for complementing the garment to be hung on the hanger; provides a positive mechanical locking arrangement for holding the erect condition of the shoulder guard, with the desired convex contour configuration, fixed against forces encountered during service, without supplemental fasteners or adhesives; enables the positive mechanical locking arrangement to be operated with ease to assure rapid and effective set-up, coupled with exemplary performance during service; employs component parts of the mechanical locking arrangement to shape and reinforce the desired contour configuration; includes visual indicators which provide a visible indication of the proper engagement of the mechanical locking arrangement for maximum effectiveness in attaining the desired contour configuration in the erected shoulder guard; enables relatively simple manufacture in large quantities of consistently high quality for widespread adoption and use.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A shoulder guard for a garment hanger, the shoulder guard being of the type erected from an essentially flat sheet of material to include a first panel and a second panel, with at least the first panel following a desired convex contour configuration to complement essentially a garment to be hung on the hanger, the first and second panels each extending longitudinally between opposite ends, the shoulder guard comprising:

a first edge extending longitudinally along the first panel;

a second edge extending longitudinally along the second panel;

an apical portion extending longitudinally between the opposite ends of the panels, laterally intermediate the first edge and the second edge;

a gap located between the opposite ends of the second panel and dividing the second panel into first and second sub-panels each extending between the gap and a corresponding opposite end of the second panel, each sub-panel including a second edge portion, an outer surface and an inner surface;

an opening located between the opposite ends of the first and second panels, intermediate the first and second edges, the opening communicating with the gap;

a first slit in the first sub-panel, the first slit extending generally laterally from the opening toward the corresponding second edge portion and including a terminus spaced laterally away from the corresponding second edge portion, the first slit being spaced longitudinally from the gap toward the corresponding end of the first panel to establish a first tab on the first sub-panel, adjacent the gap, between the gap and the first slit; and a second slit in the second sub-panel, the second slit extending generally laterally from the corresponding second edge portion toward the apical portion and including a terminus spaced laterally away from the apical portion, the second slit being spaced longitudinally from the gap toward the corresponding end of the second panel to establish a second tab on the second sub-panel, adjacent the gap, between the gap and the second slit;

the relative location and extent of the first and second slits being such that upon interengagement of the first and second slits and juxtaposition of the terminus of the first slit with the terminus of the second slit, the first and second sub-panels are locked together against relative longitudinal movement, with at least the first panel bowed into the desired convex contour configuration.

2. The invention of claim 1 wherein the outer surface of the first sub-panel includes a first outer surface portion along the first tab for confronting the inner surface of the second sub-panel along a corresponding first inner surface portion of the second sub-panel, and the outer surface of the second sub-panel includes a second outer surface portion along the second tab for confronting the inner surface of the first sub-panel along a corresponding second inner surface portion of the first sub-panel such that upon said interengagement of the first and second slits and juxtaposition of the terminus of the first slit with the terminus of the second slit, with the first outer surface portion confronting the first inner surface portion, and the second outer surface portion confronting the second inner surface portion, the first and second tabs urge the respective corresponding portions of the second and first sub-panels outwardly to shape the first and second sub-panels and thereby establish a desired convex contour configuration along the second panel.

3. The invention of claim 2 wherein the first tab has a first lateral width, and the second tab has a second lateral width, the first lateral width being somewhat less than the second lateral width, such that said interengagement of the first and second slits is facilitated, and the first and second tabs reinforce the shaped, desired convex contour configuration in the second panel.

4. The invention of claim 3 wherein the gap and the opening are located longitudinally essentially centrally between the opposite ends of the first and second panels.

5. The invention of claim 2 including:

first positive indicia on the outer surface of the first sub-panel, the first positive indicia being located closely adjacent the first slit, between the first slit and the corresponding end of the second panel; and second positive indicia on the outer surface of the second sub-panel, the second positive indicia being located closely adjacent the second tab, between the second tab and the corresponding end of the second panel;

the first and second positive indicia being complementary such that upon said interengagement of the first and second slits, and juxtaposition of the terminus of the first slit with the terminus of the second slit, with the first outer surface portion confronting the first inner surface portion, and the second outer surface portion confronting the second inner surface portion, the first and second positive indicia are visible and are combined to provide a visual confirmation that the first outer surface portion properly confronts the first inner surface portion, and second outer surface portion properly confronts the second inner surface portion.

6. The invention of claim 5 including:

first negative indicia on the outer surface of the first tab; and second negative indicia on the outer surface of the second tab;

the first and second negative indicia being complementary such that upon interengagement of the first and second slits, and juxtaposition of the terminus of the first slit with the terminus of the second slit, with the first tab overlying the outer surface of the second sub-panel and the second tab overlying the outer surface of the first sub-panel, the first and second negative indicia are visible and are combined to provide a visual indication that the first tab improperly overlies the outer surface of the second sub-panel and the second tab improperly overlies the outer surface of the first sub-panel.

7. The invention of claim 1 including:

first negative indicia on the outer surface of the first tab; and second negative indicia on the outer surface of the second tab;

the first and second negative indicia being complementary such that upon interengagement of the first and second slits, and juxtaposition of the terminus of the first slit with the terminus of the second slit, with the first tab overlying the outer surface of the second sub-panel and the second tab overlying the outer surface of the first sub-panel, the first and second negative indicia are visible and are combined to provide a visual indication that the first tab improperly overlies the outer surface of the second sub-panel and the second tab improperly overlies the outer surface of the first sub-panel.

8. The invention of claim 1 wherein the first and second slits each follow an essentially straight line.

9. The invention of claim 1 wherein the first and second slits extend essentially perpendicular to the respective second edge portions.

10. The invention of claim 9 wherein the first and second slits each follow an essentially straight line.

* * * * *